US005703567A

United States Patent [19]

Cleveland

[11] Patent Number: 5,703,567

[45] Date of Patent: Dec. 30, 1997

[54] TOILET SEAT ALARM

[76] Inventor: Michael Allen Cleveland, 2479 Deer Run #414, Lewisville, Tex. 75067

[21] Appl. No.: 717,883

[22] Filed: Sep. 23, 1996

[51] Int. Cl.[6] ..... G08B 23/00

[52] U.S. Cl. ..... 340/573; 340/686; 73/382 G; 4/661

[58] Field of Search ..... 340/573, 686, 340/689, 467; 73/382 G, 382 R; 4/661

[56] References Cited

U.S. PATENT DOCUMENTS

| | | | |
|---|---|---|---|
| D. 357,201 | 4/1995 | Novack | D10/104 |
| 3,803,579 | 4/1974 | Compton | 340/309.1 R |
| 4,512,046 | 4/1985 | Riggle | 4/661 |
| 4,733,419 | 3/1988 | Nee | 4/661 |
| 4,849,742 | 7/1989 | Warrington | 340/686 |
| 4,920,583 | 5/1990 | Hough et al. | 4/237 |
| 5,392,032 | 2/1995 | Kline et al. | 340/604 |
| 5,465,422 | 11/1995 | Dean | 455/344 |
| 5,513,397 | 5/1996 | Terry | 4/661 |

*Primary Examiner*—Jeffery Hofsass
*Assistant Examiner*—Anh La
*Attorney, Agent, or Firm*—Goldstein & Associates

[57] ABSTRACT

A toilet seat alarm comprising a housing unit having pegs for insertion into a toilet seat, resembling a standard bumper placed on the underside of a toilet seat. A timing device-alarm, power source, speaker and position sensor are located within said housing unit. When the toilet seat is placed in the raised position, the position sensor activates the timing device-alarm which in turn causes the speaker to emit a series of beeps at predetermined intervals to alert the user to the position of the toilet seat.

5 Claims, 3 Drawing Sheets

TOILET SEAT ALARM

BACKGROUND OF THE INVENTION

The invention relates to a toilet seat alarm. More particularly, the invention relates to a toilet seat alarm that is activated when the toilet seat is left in the raised position, rather than in the closed position, for a set length of time.

A standard toilet usually comprises a hinged seat and a hinged cover, both of which are ideally placed in the closed position after each use. However, because of the forgetfulness and carelessness of many users, generally men, the cover, as well as the seat, is often left in the raised position. This has proven to be the subject of many quarrels between men and women living in the same home and using the same toilet.

Besides being unattractive, a raised toilet seat can also prove to be a source of discomfort for a subsequent user who fails to notice the raised position of the seat especially in the dark.

U.S. Pat. No. 4,849,742 to Warrington discloses a toilet seat cover position alarm comprising a signaling device that is activated when the toilet seat cover is not lowered after the toilet is flushed. This invention comprises a component housing which is attached to the water tank of a toilet, a smaller switch housing which is also attached to the water tank and a magnet which is set to the toilet seat cover. Although the problem of a raised toilet seat may be remedied by this device, said device may prove to be difficult to install, as well as a cumbersome and unsightly addition to the toilet, and only works if the user remembers to flush the toilet.

U.S. Pat. No. 4,733,419 to Nee discloses a toilet seat-up indicator which brings a user's attention to the fact that the toilet seat is in the up position. In essence, the invention comprises an indicator that emits a flashing light as a warning to the next user that the seat is up. While this invention may solve the unpleasant consequences suffered when a user fails to notice the position of the toilet seat before proceeding to use the toilet, it still fails to cure the predicament by failing to notify and train the previous user to lower the seat and cover.

While these units may be suitable for the particular purpose employed, or for general use, they would not be as suitable for the purposes of the present invention as disclosed hereafter.

SUMMARY OF THE INVENTION

It is an object of the invention to produce a toilet seat alarm. More particularly, it is an object of the instant invention to produce a device that signals a user soon after the toilet seat is raised that said seat is in the raised position.

It is another object of the invention to produce a toilet seat alarm that emits a series of beeps as a warning to a user that the toilet seat is in the raised position. The beeps are timed to sound at predetermined intervals.

It is a further object of the invention to produce a toilet seat alarm that can be easily installed under the toilet seat and, hence, is invisible to the eye when the toilet seat is in the closed position, and inconspicuously undetectable when the toilet seat is in the open position as well.

The invention is a toilet seat alarm that is housed in a standard removable seat bumper and placed under the toilet seat. Upon lifting the toilet seat into the up position, the timer is activated and, shortly thereafter, emits a series of timed beeps that signal the user of the raised position of the toilet seat.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
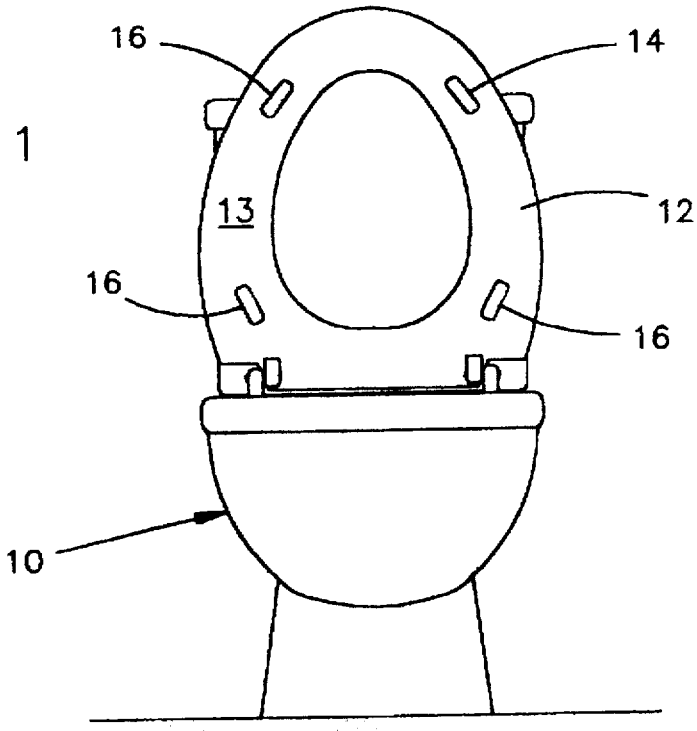
FIG. 1 is a front elevational view, illustrating a toilet with a toilet seat in the raised position having a toilet seat alarm in place, along with three other standard toilet seat bumpers.

FIG. 1 illustrates a standard toilet 10, having a toilet seat 12 shown in a raised position. The toilet seat 12 has an underside surface 13. Toilet seat bumpers 16 are in place on the underside surface 13 of the toilet seat 12. A toilet seat alarm 14 is mounted in place of one of said toilet seat bumpers 16.

Figure 2:
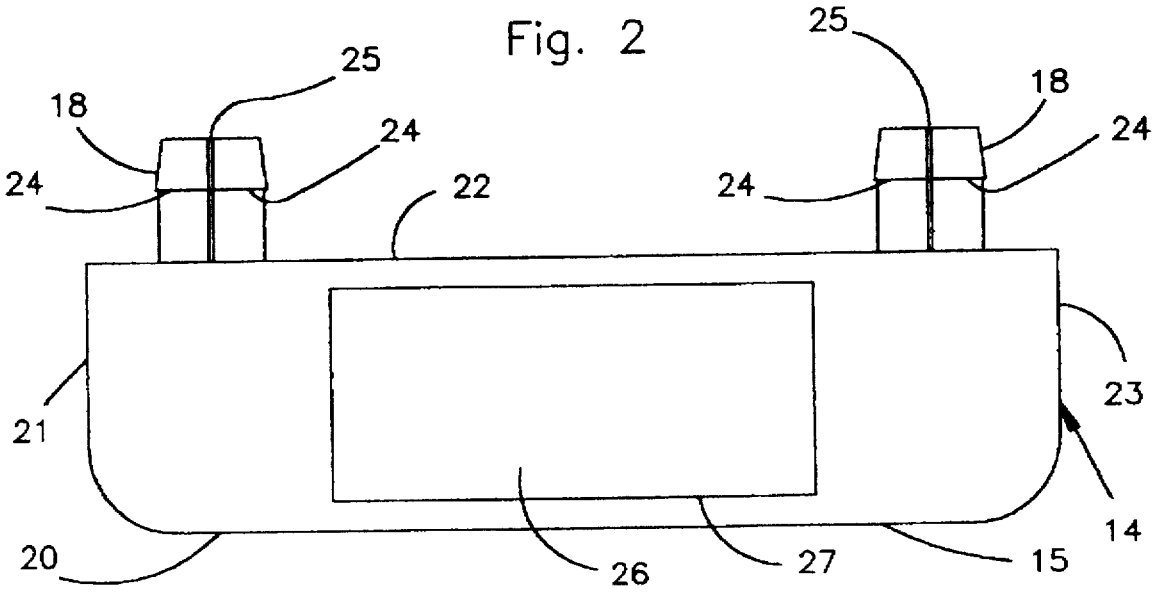
FIG. 2 is a side view of the instant invention.

FIG. 2 illustrates a side view of the toilet seat alarm 14 comprising a housing unit 15 which physically resembles the toilet seat bumpers 16 in size and shape, as well as a bottom surface 22, a top surface 20 and opposite ends 21 and 23. A peg 18 is attached to each of said opposite ends of the housing unit 15, originating at the top surface 20, extending through the entire length of the housing unit 15, through the bottom surface 22. Each peg 18 has a lip 24. A gap 25 extends through the center of each peg 18. When the toilet seat alarm 14 is placed on the toilet seat 12, the pegs 18 are inserted into fixed holes in the toilet seat 12 where a toilet seat bumper 16 was previously located, until the lips 24 of said pegs 18 fall below the underside surface 13 of the toilet seat 12 and then expand outward. The toilet seat alarm 14 is then locked in position thereat as the bumper 16 would normally attach.

Figure 3:
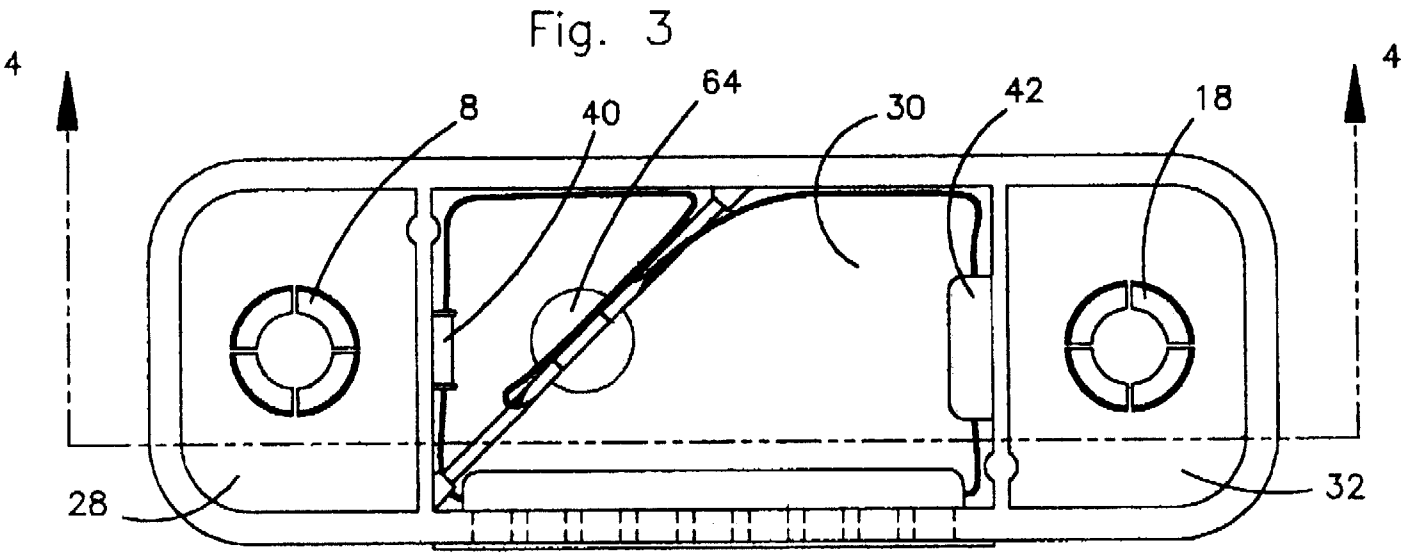
FIG. 3 is a bottom view of the instant invention.
Figure 4:
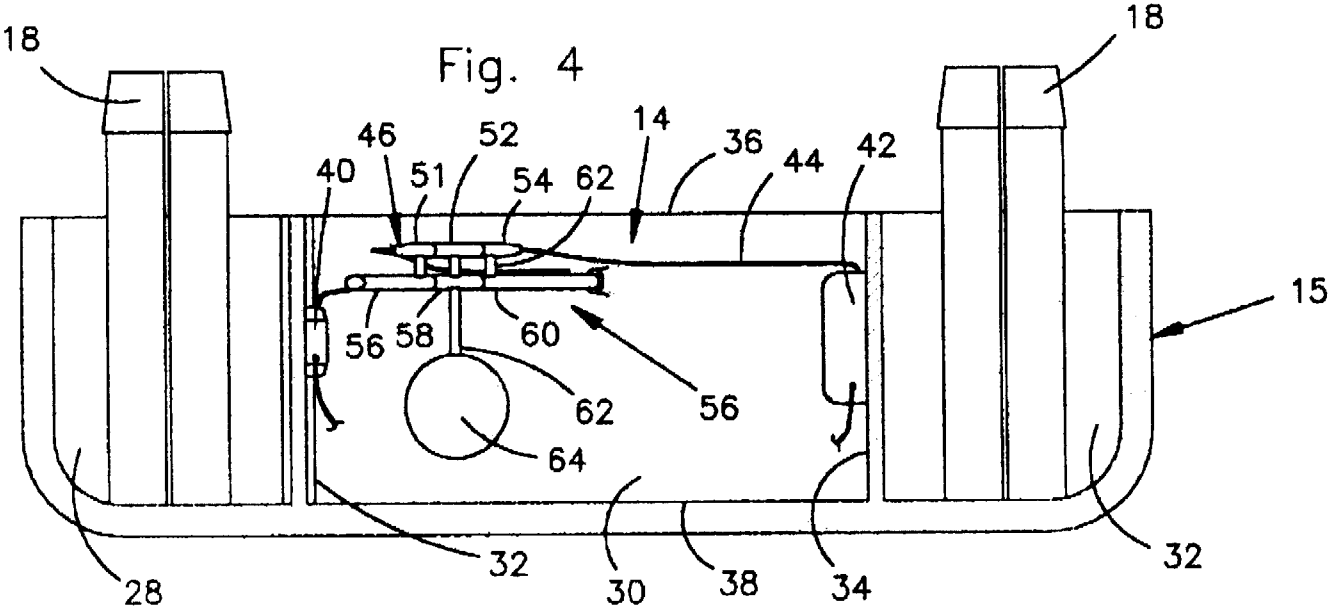
FIG. 4 is a cross-sectional view of the instant invention taken along the line 4—4 in FIG. 3.
Figure 5A:
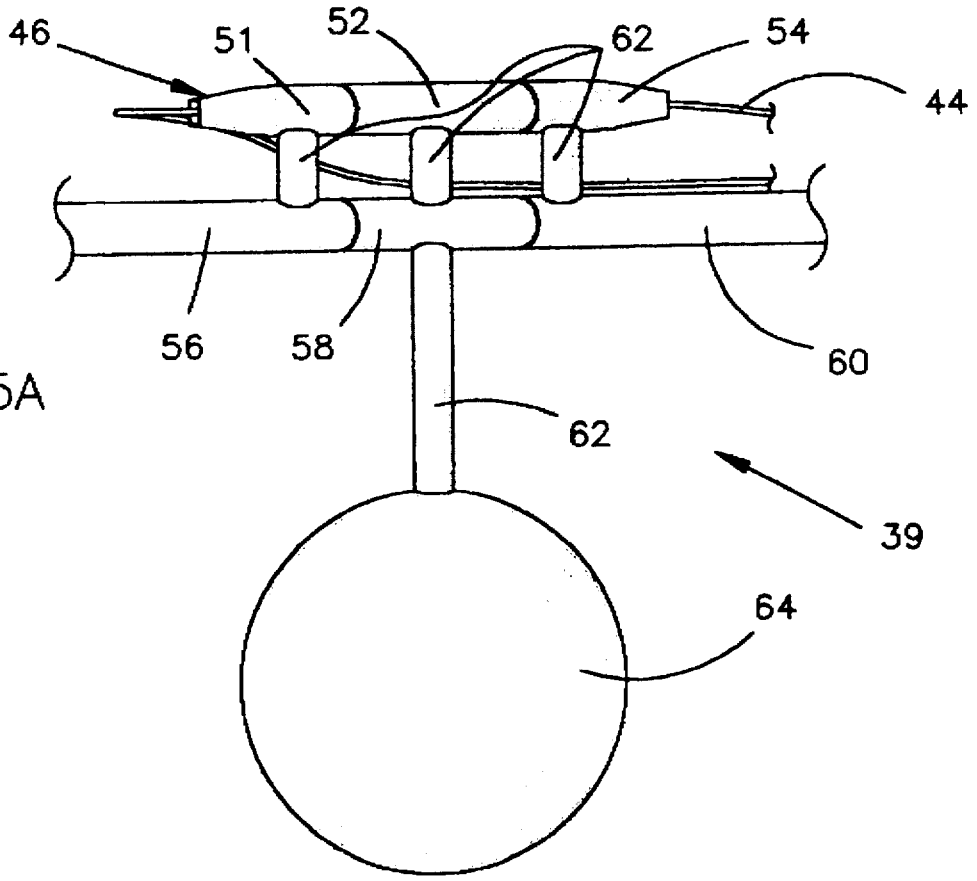
FIG. 5A illustrates a weighted pendulum, housed in the instant invention, shown when the toilet seat is in the raised position.

FIG. 4 illustrates a cross-sectional view of the alarm device 14 taken along lines 4—4 of FIG. 3. The housing unit 15 is divided into three sections 28,30,32, respectively. The two end sections 28 and 32 are each bisected by one of the pegs 18. The middle section 30 comprises two side walls 33 and 34, a bottom wall 36 and a top wall 38. The middle section 30 houses a position sensor 39, a timing device-alarm 40 attached to the side wall 33, and a power supply 42, such as a battery, attached to the side wall 34. The power supply 42 and timing device-alarm 40 are in circuit, preferably via a wire 44 or similarly conductive element. The position sensor 39 comprises a plurality of contact leads 46 that are located along the circuit between the battery and the timing device-alarm. The contact leads 46 comprise three distinct leads; outer leads 51 and 54 and center lead 52. A corresponding number of hinged tubes, 56, 58, 60, respectively are connected to each of the leads, 51, 52 and 54 by connectors 62. A weighted pendulum 64, suspended from one of said connectors 62, is attached to the hinged tube 58 which corresponds to the center lead 52. The wire 44 travels from the battery 42 to one of the outer leads and then from the opposite outer lead to the timing device-alarm 40. When the toilet seat is left in the raised position, gravity causes the pendulum 64 to shift, thereby causing the center lead 52 attached thereto to shift into line with the outer leads 51 and 54 and complete the circuit between the power supply 42 and the timing device-alarm 40, thus activating said timing device-alarm 40, as seen best in FIG. 5A. Upon activation, the timing device-alarm 40 causes a speaker 26, seen in FIG. 2, to emit an audible signal for a predetermined period, alerting someone that the toilet seat 12 is open.

Figure 5B:
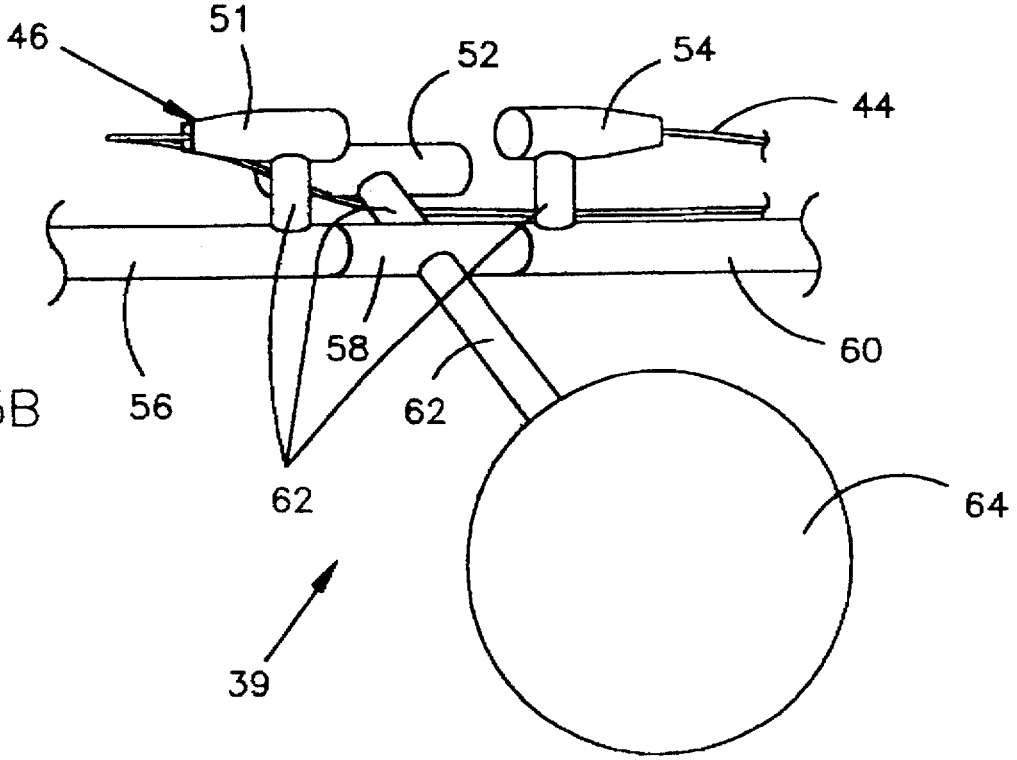
FIG. 5B illustrates a weighted pendulum, housed in the instant invention, shown when the toilet seat is in the closed or lowered position.

FIG. 5B illustrates the toilet seat alarm 14 when the toilet seat 12 is in a closed position. Gravity acting upon the pendulum 64 causes the center lead 52 to break the circuit with the outer leads 51 and 54, thereby deactivating the timing device-alarm 40 and preventing any audible alarm.

What is claimed is:

1. A toilet seat alarm, for detecting and signaling when a toilet seat is left in a raised position, comprising:

a housing unit having opposite ends and a peg located at each of said ends, said pegs inserted into predefined holes located upon an underside surface of a toilet seat to secure the toilet seat alarm thereto;

a power source, contained within said housing unit;

a speaker in circuit with said power source;

a timing device-alarm, in circuit with the power source, speaker, and a position sensor, which, upon actuation by the position sensor in response to the toilet seat being left in the open position, causes the speaker to emit an audible signal for a predetermined period; and a position sensor contained within said housing unit and in circuit with said power source and speaker, for detecting when the toilet seat is left in the raised position, comprising outer leads and a center lead, and a hinged tube connected to each of said leads by a connector, said leads located along the circuit between the power source and the timing device-alarm and speaker, with a weighted pendulum attached to the center lead and a corresponding hinged tube and a wire traveling from the power source to one of the outer leads and then from the opposite outer lead to the timing device-alarm and speaker such that when the toilet seat is placed in the raised position, gravity causes the pendulum to shift thereby causing the center lead attached thereto to shift into line with the outer leads and complete the circuit between the power supply and the timing device-alarm, thus activating said timing device-alarm and causing the speaker to emit an audible signal for a predetermined period, alerting someone that the toilet seat is open.

2. The toilet seat alarm as recited in claim 1, wherein the housing unit comprises the same shape as a toilet seat bumper, so that said toilet seat alarm may simply and inconspicuously replace one of a plurality of the existing toilet seat bumpers affixed to the toilet seat.

3. A toilet seat alarm, for detecting and signaling when a toilet seat is left in a raised position, comprising:

a housing unit, comprising the same shape as a toilet seat bumper, so that said toilet seat alarm may simply and inconspicuously replace one of a plurality of the existing toilet seat bumpers affixed to the toilet seat, having opposite ends and a peg located at each of said ends, said pegs inserted into predefined holes located upon an underside surface of a toilet seat to secure the toilet seat alarm thereto;

a position sensor contained within said housing unit for detecting and signaling when the toilet seat is left in the raised position; and a speaker, in circuit with said position sensor, for emitting an audible alert in response to an indication by the position sensor that the toilet seat has been left in the raised position.

4. The toilet seat alarm as recited in claim 3, further comprising:

a power source, contained within said housing unit; and a timing device-alarm, in circuit with the power source, speaker, and position sensor, which, upon actuation by the position sensor in response to the toilet seat being left in the open position, causes the speaker to emit an audible signal for a predetermined period.

5. The toilet seat alarm as recited in claim 4, wherein the position sensor further comprises outer leads and a center lead, and a hinged tube connected to each of said leads by a connector, a weighted pendulum is attached to the center lead and corresponding hinged tube, and a wire travels from the power source to the one of the outer leads and then from the opposite outer lead to the timing device-alarm and speaker such that when the toilet seat is placed in the raised position, gravity causes the pendulum to shift thereby causing the center lead attached thereto to shift into line with the outer leads and complete the circuit between the power supply and the timing device-alarm, thus activating said timing device-alarm and causing the speaker to emit an audible signal for a predetermined period, alerting someone that the toilet seat is open.

* * * * *